US006259415B1

(12) United States Patent
Kumpfbeck et al.

(10) Patent No.: US 6,259,415 B1
(45) Date of Patent: Jul. 10, 2001

(54) MINIMUM PROTRUSION MECHANICALLY BEAM STEERED AIRCRAFT ARRAY ANTENNA SYSTEMS

(75) Inventors: Richard J. Kumpfbeck, Huntington; John F. Pedersen; Joseph T. Merenda, both of Northport, all of NY (US)

(73) Assignee: BAE Systems Advanced Systems, Greenlawn, NY (US)

( * ) Notice: Subject to any disclaimer, the term of this patent is extended or adjusted under 35 U.S.C. 154(b) by 0 days.

(21) Appl. No.: 09/350,449

(22) Filed: Jul. 9, 1999

Related U.S. Application Data

(62) Division of application No. 08/659,973, filed on Jun. 3, 1996, now abandoned.

(51) Int. Cl.[7] ..... H01Q 3/08; H01Q 13/10

(52) U.S. Cl. ..... 343/765; 343/771

(58) Field of Search ..... 343/705, 765, 343/766, 770, 771, 713, 882; H01Q 13/10, 3/08

(56) References Cited

U.S. PATENT DOCUMENTS 5,420,598 5/1995 Uematsu et al. ..... 343/765

5,579,019 * 11/1996 Uematsu et al. ..... 343/771

* cited by examiner

*Primary Examiner*—Michael C. Wimer
(74) *Attorney, Agent, or Firm*—Edward A. Onders; Kenneth P. Robinson

(57) ABSTRACT

Low-protrusion array antennas enable reception of satellite signals by airliners in flight. Prior systems using a beam normal to an array face required a 70° array tilt for reception from a satellite at 20° elevation (i.e., tilt angle is complementary angle (90°−β) of satellite angle (β) of elevation). Compared to that 70° array tilt for reception from a satellite at 20° elevation, disclosed antennas require an array tilt of only 25° (90°−β−α=25°). This is accomplished by providing a beam at a fixed acute angle (α) to the array face (e.g. 45 degrees). A side-by-side linear array 16 of slotted waveguide radiator columns 18 provides a pencil beam at a fixed acute angle of 45° to array aperture, for example. By action of tilting motor 42 to mechanically tilt the array of slotted waveguides over a range of ±25° from horizontal, the beam can be scanned from 20° elevation to 70° elevation. Azimuth rotator motor 30 provides 360° beam pointing in azimuth. A television satellite can thus be tracked by an aircraft mounted antenna with only about a 5 inch above-fuselage protrusion.

14 Claims, 3 Drawing Sheets

MINIMUM PROTRUSION MECHANICALLY BEAM STEERED AIRCRAFT ARRAY ANTENNA SYSTEMS

RELATED APPLICATIONS

This application is a division of prior application Ser. No. 08/659,973, filed Jun. 3, 1996, abandoned.

FEDERALLY SPONSORED RESEARCH (Not Applicable)

BACKGROUND OF THE INVENTION

This invention relates to economical beam-steered array antennas and, more particularly, to such antennas using mechanical beam steering in both azimuth and elevation, and configured to minimize antenna protrusion above the surface of an airframe.

Many types of antennas are available for aircraft and other airborne applications. Particular constraints in choice of antennas for use on commercial airliners, for example, are size, weight, protrusion above the surface and complexity of installation. Cost is also a significant consideration, particularly for applications not pertaining to aircraft operation or safety systems. Such applications include receiving of television programming for airline passenger entertainment.

For applications such as airborne reception of television signals from a satellite, the aircraft antenna must provide an antenna beam pattern which is steerable both in azimuth and in elevation. Beam steering in azimuth and elevation is necessary in order to permit the relatively narrow antenna beam to be pointed at the satellite, so that the antenna can successfully receive a relatively weak satellite signal.

The required capability could be provided by a flush-mounted, electronically steered phased-array antenna providing a fully steerable beam. However, such phased-array antennas are typically both expensive and complex, with respect to the electronic circuitry required. Thus, while electronically beam steered antennas may provide the required operating and low protrusion characteristics, cost is typically a constraint foreclosing use for applications such as entertainment systems. In contrast, mechanical arrangements, such as a rotatable antenna with dish reflector, are less expensive in so far as the basic antenna is concerned. However, in an aircraft installation a rotating dish typically has a large, above-surface protrusion requiring a large radome and resulting in unacceptable drag and other disadvantages which are controlling for aircraft installations. Alternatively, a dish antenna can be internally located below the aircraft skin to reduce radome height, however this requires cutting a large hole in the aircraft fuselage which substantially increases installation costs.

In an effort to provide an economical solution to this problem, U.S. Pat. No. 5,420,598, utilizes an array antenna providing a beam normal to the array face. The antenna is mechanically rotated and tilted to enable reception from satellites at any azimuth and over a range of elevation angles. However, with a beam normal to the array face, the antenna of this patent would have to be tilted from horizontal to a tilt angle of 70 degrees to enable reception from a satellite at 20 degrees elevation. To aim the beam at the satellite the antenna must be tilted to the complementary angle of the satellite elevation (90°−20°=70° array tilt). Thus, while objectives are partially met, low antenna protrusion (i.e., low array tilt) for reception from low elevation satellites is not possible with the antennas of this patent.

Objects of the present invention are, therefore, to provide new and improved types of mechanically beam-steered aircraft array antenna systems and such antenna systems providing one or more of the following capabilities and advantages:

- fixed-tilt antenna beam from flat radiating array;
- array tilt limited by provision of fixed-tilt beam;
- 20 to 70 degree elevation coverage with array tilt limited to 25 degrees;
- no requirement for electronic beam steering;
- mechanical beam steering by rotating and tilting the radiating array;
- economical individual rotate motor and tilt motor configuration;
- omnidirectional azimuth beam steering;
- light weight, economical construction using linear array of fixed-focus slotted waveguide radiators; and
- small installation hole in aircraft for motor drive, thereby minimizing installation cost.

SUMMARY OF THE INVENTION

In accordance with the invention, a mechanical beam steer array antenna system, to enable satellite reception from a moving vehicle with limited antenna protrusion uses a fixed-beam array antenna positioned by an elevation tilter. The fixed-beam array antenna includes a plurality of slotted waveguide radiator columns positioned in a side-by-side array, each radiator column having a series of radiating slots spaced along its length with the slots dimensioned to provide maximum signal reception at a fixed acute angle ($\alpha$) relative to column length, and a feed arrangement, without beam scan capability, coupled to the radiator columns to couple signals to provide a fixed antenna beam at the fixed acute angle ($\alpha$) above an aperture plane of the side-by-side array of radiator columns. The elevation tilter is arranged to mechanically tilt the array antenna to enable reception from a satellite at an elevation angle ($\beta$) by mechanically tilting the aperture plane to a tilt angle nominally equal to the angle complementary to the satellite elevation angle ($90°-\beta$), less the acute angle ($\alpha$). The antenna tilt angle ($90°-\beta$) required for reception from low-elevation satellites is thereby limited.

In the exemplary case where the slotted waveguide slots are dimensioned to provide maximum signal reception at a fixed acute angle ($\alpha$) of 45 degrees, the required antenna tilt is reduced to 25 degrees for reception from a satellite at 20 degrees elevation. This compares to a required antenna tilt of 70 degrees for such reception by a prior antenna with a beam normal to the antenna face.

Also in accordance with the invention, a method of mechanically steering an antenna beam for satellite reception from a moving vehicle, includes the steps of:

(a) providing a fixed-beam array antenna configured to provide an antenna beam at a fixed acute angle ($\alpha$) above an antenna aperture plane, the array antenna having no adjustable beam scan capability; and (b) to receive signals from a satellite at an elevation angle ($\beta$) above horizontal, mechanically tilting the array antenna to position its aperture plane at a tilt angle nominally equal to the angle complementary to the satellite elevation angle ($90°-\beta$), less the acute angle ($\alpha$) thereby limiting the antenna tilt angle ($90°-\beta-\alpha$) required for reception from low-elevation satellites.

The above method may also typically include the additional step of:

(c) mechanically rotating the array antenna to direct the antenna beam in an azimuth direction appropriate to receive signals from the satellite.

For a better understanding of the invention, together with other and further objects, reference is made to the accompanying drawings and the scope of the invention will be pointed out in the accompanying claims.

DESCRIPTION OF THE INVENTION

Figure 1:
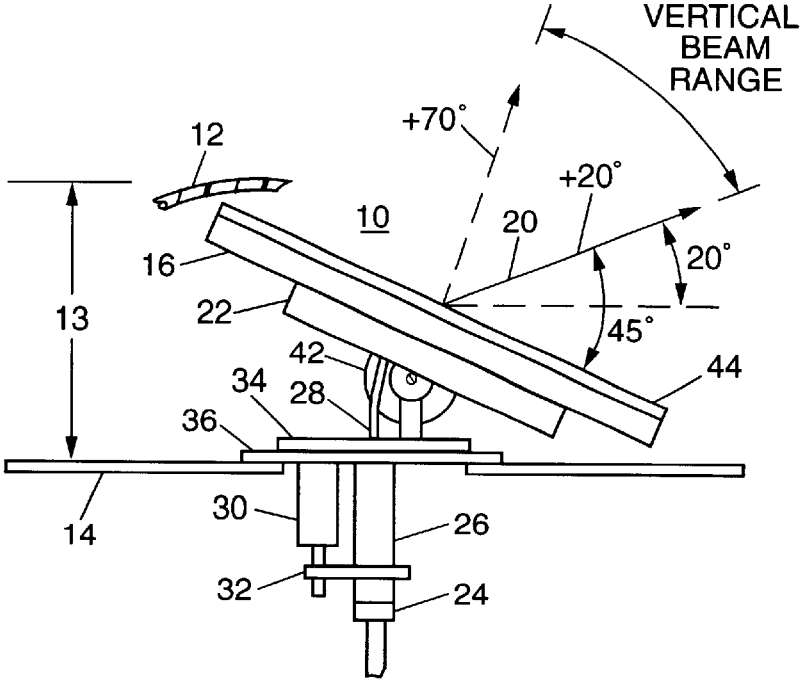
FIG. 1 is a side view of a mechanical beam steer array antenna system in accordance with the invention, which includes a linear array of slotted waveguide radiator columns.
Figure 2:
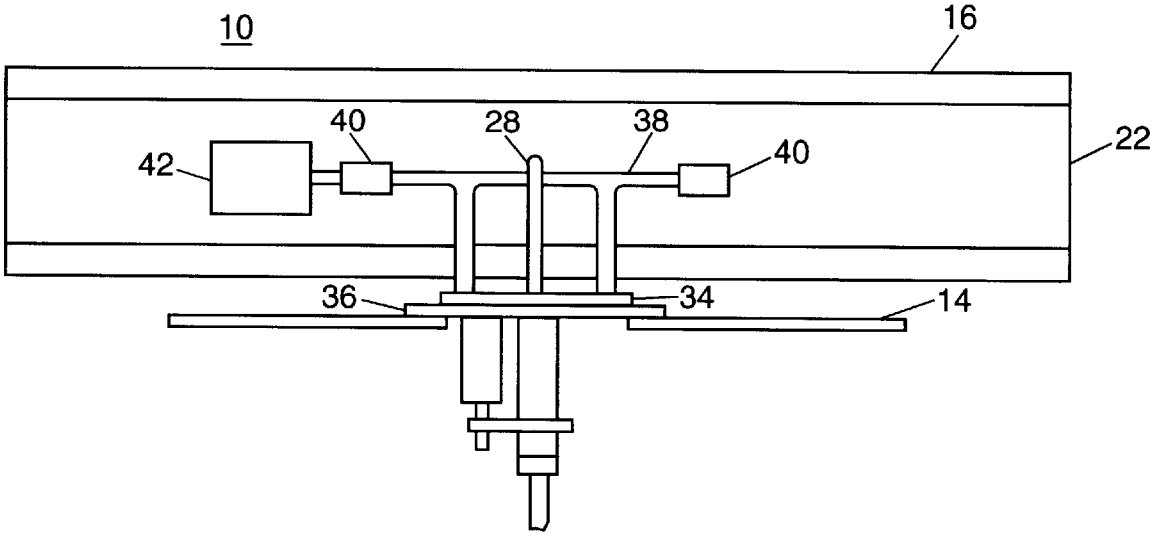
FIG. 2 is a rear view of the FIG. 1 antenna system.

FIGS. 1 and 2 are side and back views of a mechanical beam steer array antenna system 10 utilizing the present invention. As will be described, the antenna system enables high gain reception of satellite signals, when mounted on a moving vehicle. Of particular importance to aircraft installations, the antenna system may be enclosed within a radome requiring only a limited above-surface protrusion. A small section of radome is shown conceptually at 12 in FIG. 1. The position of radome 12 above the top surface of an aircraft fuselage as represented at 14, illustrates that the radome height 13 need only be sufficient to clear the antenna at a maximum tilt of 25 degrees from horizontal as shown in FIG. 1. As will be described in greater detail, the antenna need only tilt in azimuth over a range of ±25 degrees in order to point the pencil beam of the antenna at any elevation over a range from 20 degrees above to 70 degrees above the horizon. The antenna is also rotated to provide 360 degree azimuth coverage during satellite signal acquisition and tracking. FIGS. 1 and 2 are simplified views of an antenna system, not necessarily to scale, wherein certain dimensions are exaggerated for clarity of description.

As shown in FIG. 1, the antenna system includes an array 16 of radiating elements arranged to provide a planar rectangular array aperture. In the position illustrated, the array aperture has a first coordinate dimension extending into the drawing sheet and a second coordinate dimension normal to the first and inclined at an angle of 25 degrees to horizontal. As further described with reference to FIG. 3, array 16 may comprise a side-by-side linear array of 36 slotted waveguide radiator columns 18, each including a configuration of 22 series fed slots spaced along an end-exited waveguide column. As indicated by arrow 20 in FIG. 1, each slotted waveguide radiator column is configured to provide a radiation pattern having a maximum strength beam center line at a fixed acute angle nominally 45 degrees above the aperture plane.

The antenna system includes a feed arrangement coupled to the radiator columns to couple signals to provide an antenna beam in the form of a pencil beam at the fixed acute angle (e.g., 45 degrees above the aperture plane). As represented in FIG. 1, the feed arrangement includes a 36 way power divider 22 having an input port and 36 output ports, one coupled to each of the 36 radiator columns. As indicated in FIG. 1, power divider 22 is mounted behind the composite array unit 16 and may utilize successive division of an input signal to provide 36 nominally equal portions, one coupled to each radiator column or other suitable signal division arrangement. With an understanding of the invention, skilled persons can provide individual antenna components and configurations in appropriate form for particular implementations of the invention. It will be appreciated that while the antenna system is intended to operate in a signal reception mode in this embodiment, operation is reciprocal and description is sometimes facilitated by using terms of signal transmission in order to describe operation which may actually involve reception and combination of signal components. As represented in FIG. 1, the feed arrangement also includes an RF rotary joint indicated at 24, a waveguide section 26, which is also a structural member, and a coaxial type transmission line section 28 coupling signals from a probe arrangement at the top end of waveguide 26 to the input port of power divider 22.

The FIG. 1 antenna system also includes an azimuth rotator arranged to rotate the radiator array 16 and thereby steer the antenna beam in azimuth. As shown, the azimuth rotator includes electric motor 30 mounted in a fixed position and including a shaft driving a belt 32 arranged to cause rotation of waveguide section 26. Waveguide section 26 is connected to the bottom of an azimuth bearing plate 34 which is free to rotate above mounting plate 36 fixed to the aircraft fuselage. The radiator array 16 is structurally attached to the top of azimuth bearing plate 34 (as shown in more detail in FIG. 2) so as to rotate in azimuth with rotation of plate 34.

An elevation tilter is included in the antenna system and arranged to tilt or pivot the radiator array 16 and thereby adjust the antenna beam in elevation. As shown, a horizontal elevation pivot or axle 38 is mounted in fixed relation to bearing plate 34 by two structural uprights which support axle 38. The radiator array 16 and power divider 22 are coupled to axle 38 by bearing sleeves 40 which are fixed to the back of divider 22 and rotatably encompass portions of axle 38 so that the radiator array/power divider assembly is able to rotate around an axis extending longitudinally through the center of axle 38. The elevation tilter of the antenna system comprises an electrical actuator 42, which may have the form of a stepping motor. Actuator 42 is attached to the bottom of power divider 22, with a rotatable member fixed to the axle 38. The actuator is provided in a suitable configuration so that upon selective electrical activation, rotation of the rotatable member of actuator 42 causes tilting or pivoting of the radiator array/power divider assembly around the center axis of axle 38. Tilting of the radiator array directly adjusts the elevation angle of the pencil beam pattern which has a beam center line 20 at a fixed angle of 45 degrees to the aperture plane in this embodiment.

Although not shown, electrical signals to control activation of azimuth drive motor 30 can be provided by wiring directly connected to the motor, which is fixed in position. Actuator 42, however, rotates with the radiator assembly and electrical control signals can be provided by a slip ring arrangement carried on the outside of the rotatable waveguide section 26 or by other suitable arrangement. With reference to FIGS. 1 and 2, it will be appreciated that this embodiment requires only a relatively small hole in the outer surface of the aircraft fuselage represented at 14. Aside from elements of the azimuth drive rotator and certain signal transmission components, the antenna system is positioned externally to the fuselage. Thus, the array of radiating elements 16, the feed arrangement 22 and the elevation tilter 42 are all external to the surface of the aircraft fuselage 14. A radome, a portion of which is represented at 12, can be separately fastened to the fuselage to cover the antenna. Installation costs, as well as costs of possible structural integrity corrections necessitated by larger openings, increase rapidly with the size of required fuselage openings. The small size of the hole required in the illustrated embodiment of the invention tends to minimize such costs.

In the illustrated embodiment, the antenna system also includes a polarization converter 44 positioned in front of radiator array 16. Polarization converter 44 may be provided in the form of a unit which is a portion of a wavelength in thickness and comprises appropriately dimensioned and oriented conductive elements supported in a medium of relatively low dielectric constant. Many forms of such converters are known and may typically include a number of spaced dielectric layers each bearing differently aligned straight, angled, or meander line metallic patterns, with the dielectric layers held in spaced parallel relationship by low dielectric constant foam material. For reception of circularly polarized satellite transmissions, converter 44 is arranged to provide conversion to linear polarization for efficient coupling of the satellite signals to the slotted waveguide radiator columns of array 16. Skilled persons can provide polarization converters of this or other types, as suitable for particular configurations of antennas utilizing the invention.

Figure 3:
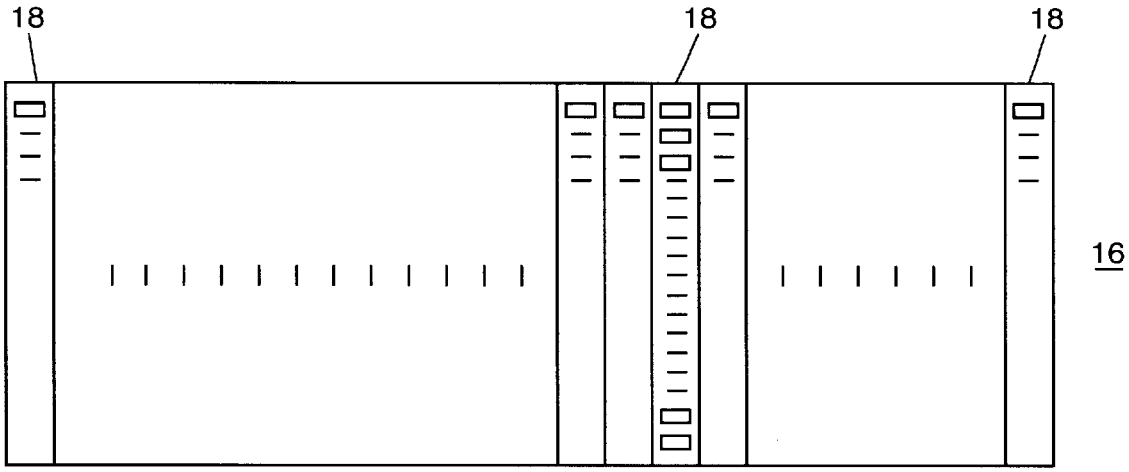
FIG. 3 is a view normal to the aperture of the linear array of slotted waveguide radiator columns of the FIG. 1 antenna system.

Referring now to FIG. 3, there is shown a simplified front view normal to the aperture plane of the array of radiator elements 16 of FIG. 1. Array 16 comprises a linear array of 36 slotted waveguide radiator columns aligned in side-by-side relationship. In this embodiment, all of the radiator columns are identical and, as represented by radiator column 18, each has 22 radiating slots. The slots are spaced and dimensioned so that when a waveguide located behind the slots in unit 18 is excited from the upper end, a focused beam pattern is formed with a beam center line inclined at a fixed acute angle of nominally 45 degrees to the aperture plane, as shown in FIG. 1. A beam with its center line at a different angle can be provided for other applications, by use of appropriate design parameters. Thus, the plurality of slots in a single radiator column provides antenna pattern focusing relative to a first coordinate direction along the radiator column and inclusion of a plurality of side-by-side radiator columns provides antenna pattern focusing relative to a second coordinate direction, normal to the first coordinate direction. The result is provision of a high gain pencil beam pattern.

In many antennas an objective is to be able to provide a focused beam normal to the aperture plane of the antenna and it may also be an object to electronically scan such beam. In contrast, in the illustrated antenna system an objective is to provide a focused pencil beam at a fixed acute angle (e.g., 45 degrees) to the aperture plane, as shown in FIG. 1, and to rely on mechanical movement of the radiator array to steer the beam in azimuth and elevation (without change in the fixed acute angle of the beam to the aperture plane). For a specific design, the fixed angle may vary somewhat dependent upon the specific frequency within an operating frequency band. The present form of radiating array, using a linear array of slotted waveguide radiator columns, has been found to result in very limited variation in the beam angle over an operating frequency range. For purposes of this application, "nominal" is defined as referring to a value or condition which is within plus or minus 20 percent or 10 degrees of a stated value, condition or angle.

Figure 4:
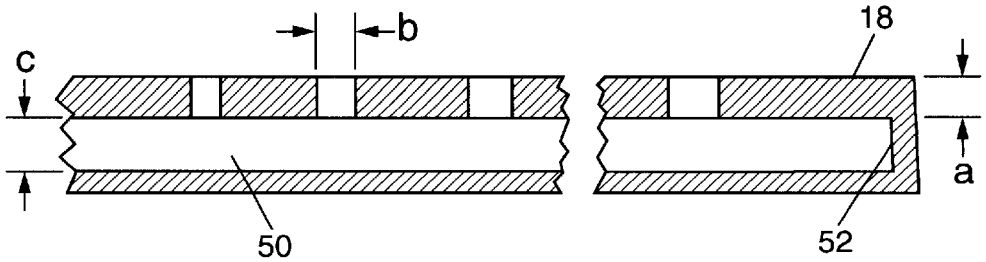
FIG. 4 is a side sectional view of one slotted waveguide radiator column of the FIG. 3 array.

FIG. 4 is a simplified, side sectional view of a portion of radiator column 18 of FIG. 3. As shown, a waveguide 50, shown cut through its narrow dimension, runs the length (i.e., vertically in FIG. 3) of column 18, with a short circuit termination at end 52 remote from the excitation end. A particular antenna design for operation within a 12–13 GHz band included the following features and dimensions. Each radiator column was approximately 11 inches in length and included 22 slot radiating elements. The slots were spaced by one-half inch center-to-center and the narrow dimension "b" of individual slots increased from approximately 0.06 to 0.2 inch from the excitation end toward the shorted end 52, with the last slot having a narrow dimension of 0.4 inch. The slot length dimension "a" above the waveguide was approximately 0.3 inch, with a waveguide narrow dimension "c" of 0.187 inch. The linear side-by-side array of 36 identical slotted waveguide columns had a width of approximately 34 inches. This configuration would require a maximum height clearance inside a radome of only about 5 inches for the maximum 25 degree antenna tilt condition illustrated in FIG. 1. It will be appreciated that this limited radome height requirement is very significant in terms of drag characteristics, FAA aircraft certification requirements and cost, with respect to antenna use on commercial airliners.

Figure 5A:
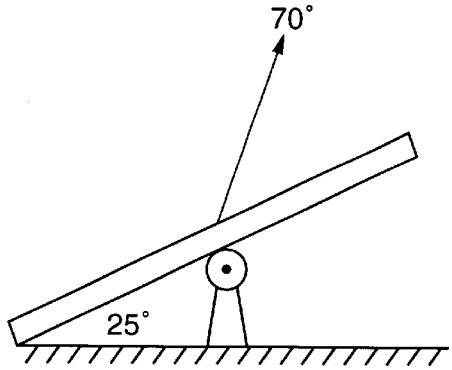
FIGS. 5A, 5B and 5C are conceptual side views of the FIG. 1 antenna system for conditions of maximum beam tilt, 45 degree beam tilt and minimum beam tilt, respectively, for elevation pointing of the beam of the FIG. 1 antenna.
Figure 5B:
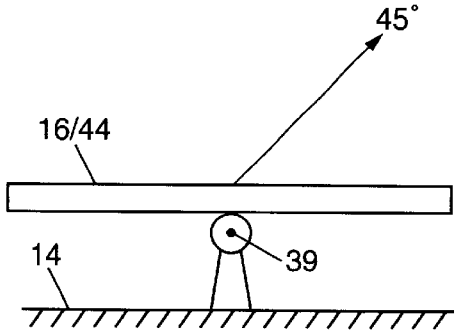
Figure 5C:
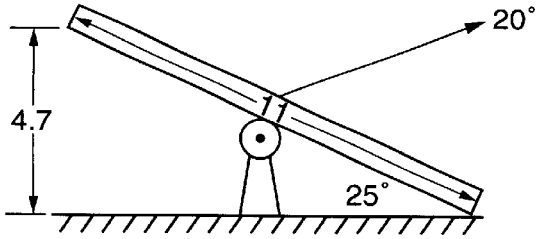

FIGS. 5A, 5B and 5C conceptually illustrate azimuth beam pointing in the context of the present invention. FIG. 5B shows a horizontally aligned planar radiator array 16 in side profile. As previously described, by use of an appropriately excited array of slotted waveguide radiator columns or other suitable array of radiator elements, an antenna pattern characterized by a pencil beam aligned at a fixed angle is provided. In this example the beam centerline 20 is at an angle of 45 degrees relative to the aperture plane (which may be denoted as angle $\alpha$), as shown. In FIG. 5C the radiator array 16 has been tilted or pivoted (i.e., rotated clockwise) 25 degrees about axis 39. As a result, in FIG. 5C beam centerline 20, which had been aligned at an elevation angle of 45 degrees above horizontal, is now aligned at an elevation angle of 20 degrees above horizontal. In FIG. 5A the radiator array 16 has been tilted 25 degrees counterclockwise, resulting in alignment of beam centerline 20 at an elevation angle of 70 degrees. In this manner, the beam can be selectively pointed at a satellite at any angle above an aircraft within the range of 20 to 70 degrees above horizontal (which may be denoted as the satellite elevation angle $\beta$). Thus, with the beam fixed at an acute angle (e.g., $\alpha$=45 degrees) to the array face or aperture plane, for reception from a satellite at an elevation angle (e.g., $\beta$=20 degrees) the array need only be tilted to the angle complementary to the satellite elevation angle ($90°-\beta$) less the acute angle ($\alpha$), for a maximum required array tilt ($90°-\beta-\alpha$) of only 20 degrees. This elevational adjustment range of 20 to 70 degrees is adequate to aim the antenna beam at satellites broadcasting television signals from orbit positions above North America and Europe. Although not illustrated in FIGS. 5A, 5B and 5C, the 20 to 70 degree elevation coverage can be obtained at any azimuth by the capability of mechanically rotating the antenna selectively over 360 degrees in azimuth. In application of the invention, different elevational beam coverage ranges can be provided by appropriate adjustment of antenna design parameters.

The maximum required array tilt of 25 degrees as described for reception from a satellite at 20 degrees elevation should be contrasted to prior systems. For a system with a beam normal to an array face, as in the prior art, an array tilt of 70 degrees is required for reception from a satellite at 20 degrees elevation.

While there have been described the currently preferred embodiments of the invention, those skilled in the art will recognize that other and further modifications may be made without departing from the invention and it is intended to claim all modifications and variations as fall within the scope of the invention.

What is claimed is:

1. A mechanical beam steer antenna system, to enable satellite reception from a moving vehicle with limited antenna protrusion, comprising:

a fixed-beam array antenna, configured to provide a beam at a fixed acute angle above an aperture plane, including an array of radiating elements having an aperture plane, and a feed arrangement coupled to said array to couple signals to provide a fixed beam at said fixed acute angle, the feed arrangement lacking a beam scan capability;

an azimuth rotator arranged to rotate the array antenna to steer said beam in azimuth to a satellite azimuth; and an elevation tilter arranged to mechanically tilt the array antenna to adjust said beam in elevation to point the beam at the satellite;

the system arranged to reduce the aperture plane tilt angle to point the beam at a low elevation satellite, as compared to the required aperture tilt angle for an antenna having a beam normal to its aperture plane.

2. An antenna system as in claim 1, wherein, to point the beam at a satellite at a low elevation angle, the elevation tilter tilts the aperture plane of the array antenna to a tilt angle which is reduced by the complement of said fixed acute angle, as compared to the required aperture tilt angle for an antenna having a beam normal to its aperture plane.

3. An antenna system as in claim 1, wherein said array antenna provides said beam in the form of a pencil beam at a fixed acute angle of 45 degrees.

4. An antenna system as in claim 3, wherein the elevation tilter tilts the array antenna to tilt the aperture plane to an angle of 25 degrees to point the beam at a satellite at an elevation angle of 20 degrees.

5. An antenna system as in claim 1, wherein said array antenna provides said beam at a fixed acute angle of 45 degrees and the elevation tilter is arranged to tilt the array antenna to tilt the aperture plane to a maximum tilt of 25 degrees.

6. An antenna system as in claim 1, wherein said array of radiating elements comprises:

a plurality of slotted waveguide radiator columns positioned in a side-by-side array, each radiator column having a series of radiating slots spaced along its length with said slots dimensioned to provide maximum signal reception at said fixed acute angle relative to column length.

7. An antenna system as in claim 6, wherein said slots are dimensioned to provide maximum signal reception at a fixed acute angle of 45 degrees relative to the length of the waveguide column radiators.

8. An antenna system as in claim 6, wherein said feed arrangement is a power divider/combiner suitable to divide a signal into a number of signals of nominally equal amplitude and equal phase, one for each of said plurality of slotted waveguide radiators, without a capability to adjust signal amplitude or phase for beam scan purposes.

9. An antenna system as in claim 6, wherein each said radiator column comprises a waveguide approximately 11 inches in length with 22 spaced radiating slots spaced one-half inch center-to-center, each waveguide including individual radiating slots of differing narrow dimension in the range of 0.1 to 0.2 inch, the radiating slots dimensioned to provide an antenna beam at a fixed acute angle of 45 degrees in operation in a 12–13 Ghz frequency band.

10. An antenna system as in claim 6, wherein each said radiator column includes radiating slots of differing narrow dimension spaced along the length of the radiator column to provide maximum signal reception at said fixed acute angle relative to column length.

11. An antenna system as in claim 6, wherein all of said radiator columns are substantially identical and said antenna beam is provided (i) at said fixed acute angle relative to the aperture plane dimension which is parallel to radiator column length and (ii) perpendicular to the aperture plane dimension which is perpendicular to radiator column length.

12. A method of mechanically steering an antenna beam for satellite reception from a moving vehicle, comprising the steps of:

(a) providing an antenna beam at a fixed acute angle above an aperture plane of a fixed beam array antenna;

(b) mechanically rotating said array antenna to direct the antenna beam in an azimuth direction appropriate to receive signals from a satellite; and (c) to receive signals from a satellite at an elevation angle above horizontal, mechanically tilting said array antenna to position its aperture plane at a tilt angle nominally equal to said acute angle less said satellite elevation angle, thereby limiting the antenna tilt angle required for reception from low-elevation satellites.

13. A method as in claim 12, wherein step (a) includes providing said antenna beam in the form of a pencil beam.

14. A method as in claim 12, wherein step (c) includes tilting the antenna to position its aperture plane at a tilt angle which is reduced by the complement of said fixed acute angle, as compared to the aperture tilt angle required for reception from a low-elevation satellite by an antenna having a beam normal to its aperture plane.

* * * * *